US009435345B2

(12) United States Patent
Otsuka et al.

(10) Patent No.: US 9,435,345 B2
(45) Date of Patent: Sep. 6, 2016

(54) IMPELLER FOR AXIAL FLOW FAN AND AXIAL FLOW FAN USING THE SAME

(71) Applicant: MINEBEA CO., LTD., Kitasaku-Gun, Nagano (JP)

(72) Inventors: Takako Otsuka, Fukuroi (JP); Takeshi Ozawa, Fukuroi (JP)

(73) Assignee: Minebea Co., Ltd., Nagano (JP)

( * ) Notice: Subject to any disclaimer, the term of this patent is extended or adjusted under 35 U.S.C. 154(b) by 719 days.

(21) Appl. No.: 13/716,672

(22) Filed: Dec. 17, 2012

(65) Prior Publication Data

US 2013/0156561 A1 Jun. 20, 2013

(30) Foreign Application Priority Data

Dec. 20, 2011 (JP) ..... 2011-278590

(51) Int. Cl.
*F04D 19/00* (2006.01)
*F04D 29/38* (2006.01)

(52) U.S. Cl.
CPC ..... *F04D 19/002* (2013.01); *F04D 29/384* (2013.01)

(58) Field of Classification Search
CPC ..... F04D 19/002; F04D 29/384; F04D 29/38
USPC ..... 416/242, 223 R
See application file for complete search history.

(56) References Cited

U.S. PATENT DOCUMENTS

| | | | | |
|---|---|---|---|---|
| 5,186,605 | A * | 2/1993 | Tracy | 601/2 |
| 6,116,856 | A | 9/2000 | Karadgy et al. | |
| 6,254,476 | B1 * | 7/2001 | Choi | 454/329 |
| 6,911,636 | B2 * | 6/2005 | Shon | 219/757 |
| 2003/0190234 | A1 * | 10/2003 | Huang | 416/228 |

FOREIGN PATENT DOCUMENTS

| | | | |
|---|---|---|---|
| JP | S5073209 | A | 6/1975 |
| JP | H05280489 | A | 10/1993 |
| JP | H0693998 | A | 4/1994 |
| JP | 8-303391 | A | 11/1996 |
| JP | 2007-529681 | A | 10/2007 |
| JP | 2009-097430 | A | 5/2009 |
| JP | 2009250225 | A | 10/2009 |
| WO | 2005/091896 | A2 | 10/2005 |

OTHER PUBLICATIONS

Office Action issued on Sep. 29, 2015 in the corresponding Japanese Patent Application No. 2011-278590.

* cited by examiner

*Primary Examiner* — Dwayne J White
*Assistant Examiner* — Julian Getachew
(74) *Attorney, Agent, or Firm* — Carrier Blackman & Associates, P.C.; William D. Blackman; Joseph P. Carrier

(57) ABSTRACT

There is provided an impeller for an axial flow fan, which includes a plurality of blades arranged in a circumferential direction. In each of the blades, with respect to a center point of a chord length of the blade, a leading edge side shape of the blade and a trailing edge side shape of the blade are line-symmetric, and a shape of the blade at one face side is different from a shape of the blade at the other face side.

6 Claims, 7 Drawing Sheets

-- Prior Art --

-- Prior Art --

-- Prior Art --

IMPELLER FOR AXIAL FLOW FAN AND AXIAL FLOW FAN USING THE SAME

BACKGROUND OF THE INVENTION

1. Field of the Invention

The present invention relates to an impeller for an axial flow fan, and an axial flow fan using the impeller, and more particularly, to an impeller which maintains an air flow characteristic in a normal rotation direction without a significant deterioration in the air flow characteristic even in a case of rotating in a reverse direction, and an axial flow fan using the impeller.

2. Description of the Related Art

Axial flow fans have been used for blowing or cooling of electronic devices such as home appliances and information devices.

Electronic devices such as personal computers and copy machines include a number of electronic components accommodated in a relatively small casing. Therefore, heat generated from the electronic components stays in the casing, possibly resulting in destroying the electronic components. Thermal destruction causes a big problem for the device. For this reason, a ventilation hole is provided on the side wall or ceiling of the casing of the electronic device. The heat generated in the casing is discharged from the ventilation hole to the outside. Also, axial flow fans have been used as cooling means for electronic devices.

FIG. 7 is a front view showing a related-art axial flow fan.

The axial flow fan is disclosed in JP-A-H8-303391, and FIG. 8 is a cross-sectional view taken along a line B-B' of a blade shown in FIG. 7. The blade shape of the axial flow fan shown in FIGS. 7 and 8 configures a forward swept blade. In order to increase an air flow, the blade shape is bent with respect to a rotation direction (normal rotation direction) such that a pressure surface side becomes a concave surface.

Some axial flow fan is rotatable in a reverse direction to change an air flow direction such that the axial flow fan can be used not only for blowing but also for exhaust. Since the related-art axial flow fan as shown in FIGS. 7 and 8 has the blade shape for increasing an air flow with respect to the normal rotation direction, in a case of rotating the axial flow fan in the reverse direction, the air flow characteristic is significantly deteriorated as compared to the case of the normal rotation direction.

Meanwhile, there is a known bi-directional axial blower which is rotatable in a normal direction and a reverse direction and is called as a jet fan for air ventilation of a tunnel or the like (see JP-A-2009-097430, for example). The jet fan is configured to have the same air flow characteristic even if an air flow direction is changed between the normal direction and the reverse direction. Therefore, it is possible to send air forward or backward in a tunnel according to the internal environment situation of the tunnel.

FIG. 9 is a cross-sectional view showing a blade of the axial blower of JP-A-2009-097430.

As shown in FIG. 9, the blade is S-shaped, and has a point symmetrical shape with respect to a point A (the center of the blade chord). The thickness of the blade has the maximum value h at the position of the point A, and is 8% to 14% with respect to the blade chord length L. The edge has a shape having a radius of curvature r of 0.25% to 0.35% with respect to the length L of the blade chord. At the position as the apex of warping, a distance X from a front end (or rear end) of the blade is about 10% with respect to the length L of the blade chord, and the height C of the warping at that position is about 2% with respect to the blade chord length. An axial flow fan having this blade shape has the same air flow characteristic in both of normal rotation and reverse rotation.

As in the axial blower disclosed in JP-2009-097430, if a blade shape is S-shaped and has a point symmetrical shape, even if the rotation direction is changed, the same air flow characteristic can be achieved. However, in this case, the air flow characteristic in the normal rotation direction is deteriorated as compared to the axial flow fan disclosed in JP-A-H8-303391. For this reason, in a case where a high air flow characteristic in the normal rotation direction is required, a blower as disclosed in JP-A-2009-097430 may not satisfy that requirement.

SUMMARY OF THE INVENTION

The present invention has been made in view of the above circumstances, and an object of the present invention is to provide an impeller which can maintain an air flow characteristic in a normal rotation direction of an axial flow fan while suppressing a significant deterioration in the air flow characteristic even in a case of rotating in a reverse direction by designing the shape of the impeller, and an axial flow fan using the impeller.

According to an aspect of the present invention, there is provided an impeller for an axial flow fan, comprising: a plurality of blades arranged in a circumferential direction. In each of the blades, with respect to a center point of a chord length of the blade, a leading edge side shape of the blade and a trailing edge side shape of the blade are line-symmetric, and a shape of the blade at one face side is different from a shape of the blade at the other face side.

In the above impeller, the shape of the blade at the one face side may be defined by a concave shape having an arc shape with a predetermined radius of curvature, and the shape of the blade at the other face side may be defined by a convex shape having an arc shape with a predetermined radius of curvature.

In the above impeller, the one face side may be a pressure face side during a normal rotation of the impeller.

According to another aspect of the present invention, there is provided an axial flow fan comprising: the above impeller; a motor configured to rotate the impeller; and a casing which accommodates the impeller, and includes a base portion supporting the motor.

According to the above configuration, it is possible to provide an impeller which can maintain an air flow characteristic in a normal rotation direction of an axial flow fan while suppressing a significant deterioration in the air flow characteristic even in a case of rotating the axial flow fan in a reverse direction, and an axial flow fan using the impeller.

DETAILED DESCRIPTION

Hereinafter, an illustrative embodiment of the present invention will be described with reference to the accompanying drawings.

Figure 1:
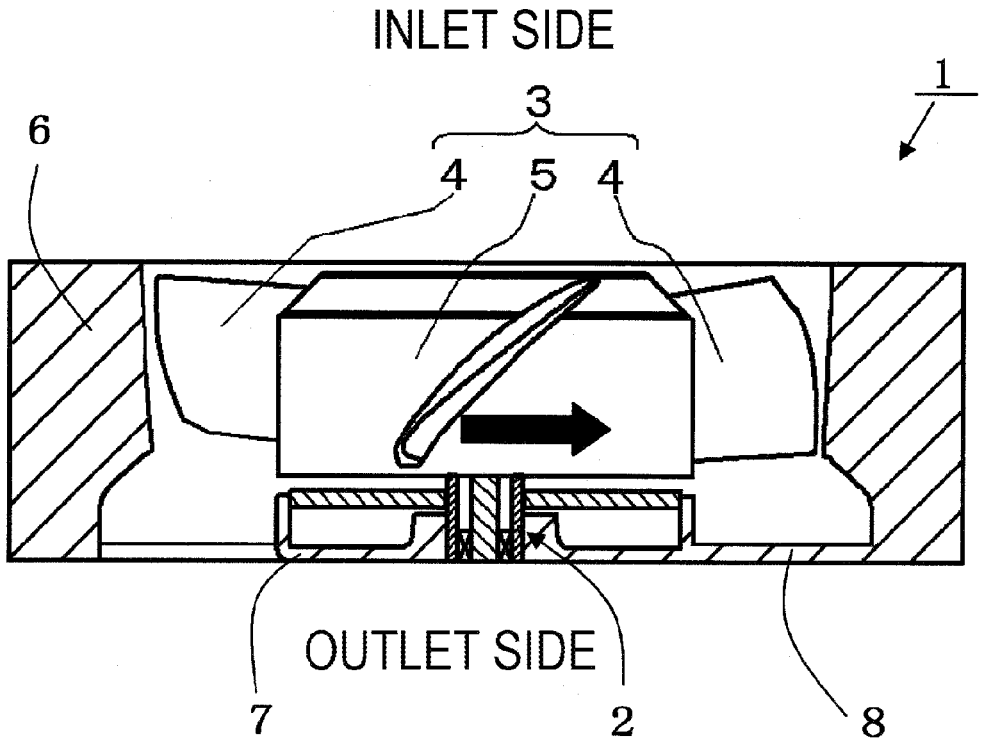
FIG. 1 is a sectional view of a center of an axial flow fan according to an illustrative embodiment of the present invention.
Figure 2:
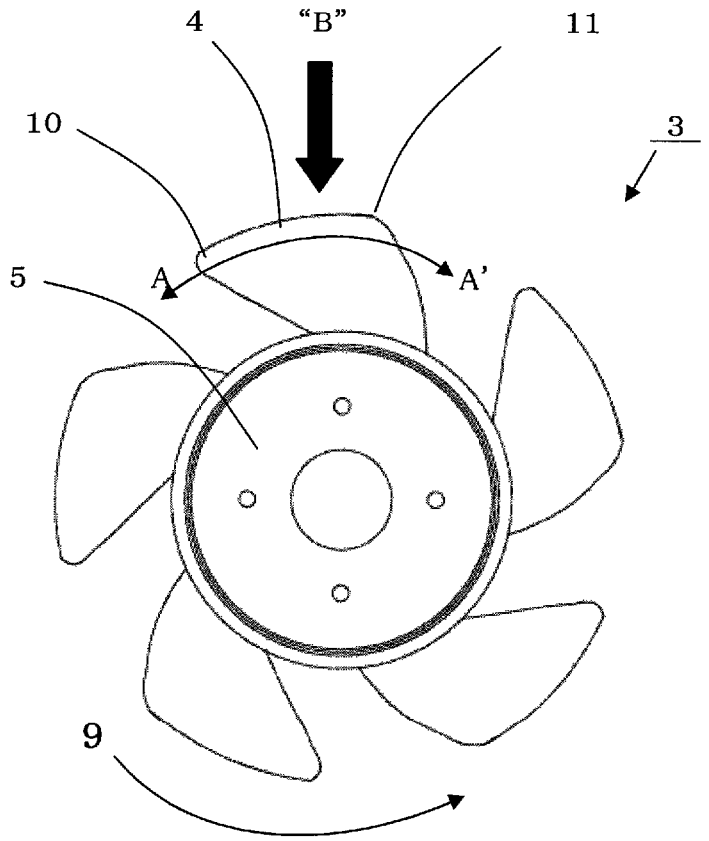
FIG. 2 is a plan view showing an impeller 3 of the axial flow fan shown in FIG. 1.

FIG. 1 is a sectional view of a center of an axial flow fan according to an illustrative embodiment of the present invention, and FIG. 2 is a plan view showing an impeller 3 of the axial flow fan shown in FIG. 1.

An axial flow fan 1 includes an impeller 3 having a plurality of blades 4 arranged in a circumferential direction, a motor 2 configured to rotate the impeller 3, and a casing 6 which accommodates the impeller 3 and has a base portion 7 supporting the motor 2.

The base portion 7 is fixed to the casing 6 by a plurality of spokes 8. If the impeller 3 rotates according to rotation of the motor 2, air is suctioned from an inlet of the casing 6, passes through the gaps between the blades 4 and the inside of the casing 6, and is discharged from an outlet of the casing 6.

The impeller 3 includes a cylindrical hub 5, and the plurality of blades 4 arranged on an outer circumferential surface of the hub 5. The blades 4 (five blades in an example shown in FIG. 2) are arranged at a regular interval in the circumferential direction. All of the blades 4 have the same shape and are formed integrally with the hub 5 by injection molding of a thermoplastic resin.

The blades 4 are forward swept blades in which the leading edges 10 of the blades 4 moves more forward than the roots of the blades 4 when normally rotating in a rotation direction of an arrow 9 in FIG. 2. However, in another illustrative embodiment, the blades 4 may be configured as sweptback blades=). In FIG. 1, the normal rotation direction of a blade at a front side is shown by an arrow of FIG. 1.

Figure 3:
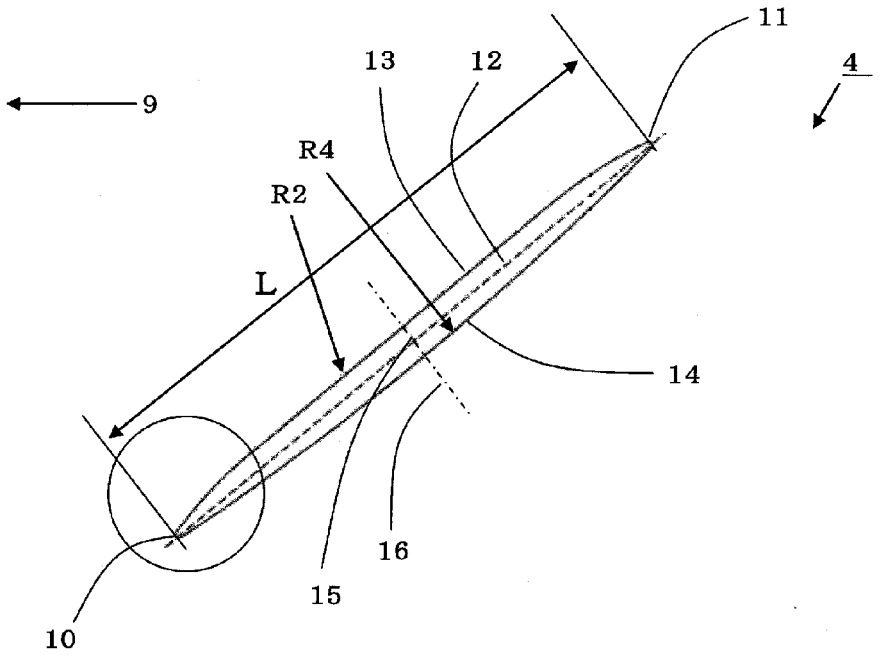
FIG. 3 is a cross-sectional view taken along a line A-A' of a blade shown in FIG. 2.
Figure 4:
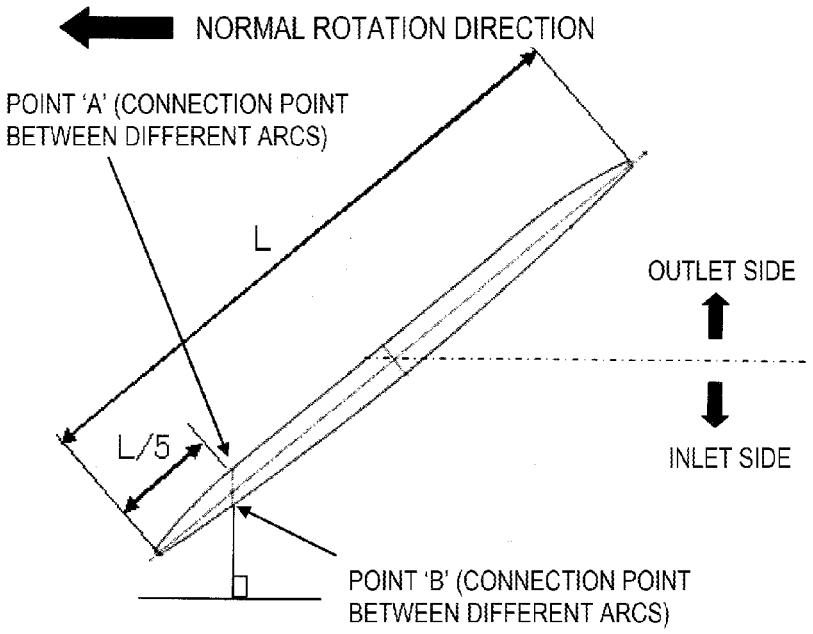
FIG. 4 is a view for explaining the cross-sectional view of FIG. 3.
Figure 5:
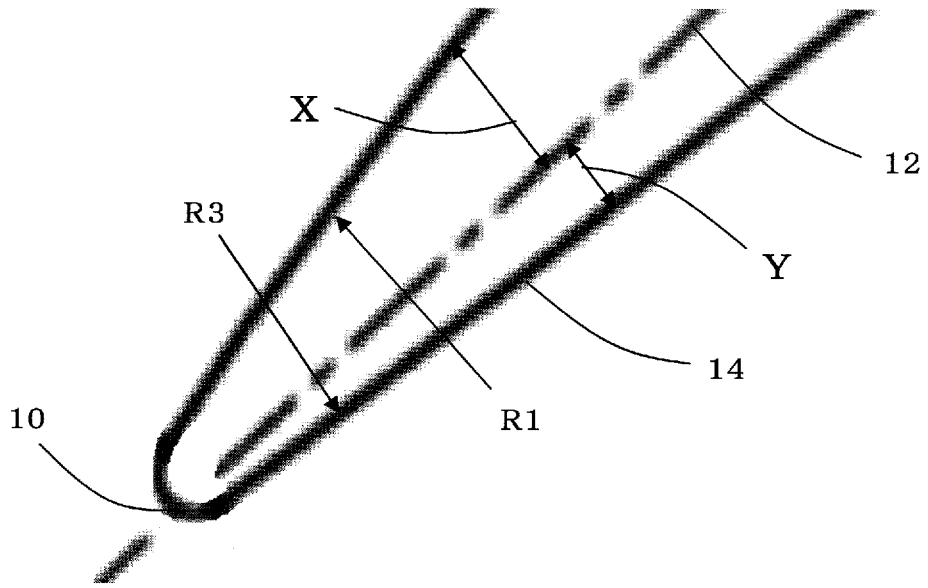
FIG. 5 is an enlarged view showing a leading edge portion of the blade shown in FIG. 3.

FIG. 3 is a cross-sectional view taken along a line A-A' of a blade shown in FIG. 2, and FIG. 4 is a view for explaining the cross-sectional view of FIG. 3. FIG. 5 is an enlarged view showing a leading edge portion (portion surrounded by a circle in FIG. 3) of the blade shown in FIG. 3.

FIGS. 3 and 4 are cross-sectional views which are taken along the line A-A' of the blade shown in FIG. 2 (a cross section taken by cutting the vicinity of the outer circumferential portion of the blade along the outer circumference) and seen from a direction "B". In FIGS. 3 and 4, an upper side is the outlet side, and a lower side is the inlet side. The normal rotation direction of the blade 4 is shown by the arrow 9 of FIG. 3.

In FIG. 3, a straight line connecting the leading edge 10 and a trailing edge 11 is a blade chord line 12. The length L of the blade chord line 12 is a blade chord length. There are shown a pressure surface 13 of the blade 4 and a suction surface 14 of the blade 4 during normal rotation.

The center portion of the surface of the pressure surface 13 of the blade 4 is formed in an arc having a predetermined radius of curvature R2, and the center of the radius of curvature R2 is provided at a side of the pressure surface 13 of the blade 4. In other words, the center portion of the surface of the pressure surface 13 of the blade 4 has a concave shape (a shape where the center portion of the pressure surface 13 becomes convex toward a side of the suction surface 14).

Both ends of the pressure surface 13 of the blade 4 are formed in an arc having a predetermined radius of curvature R1 (FIG. 5), and the center of the radius of curvature R1 is provided at a side of the suction surface 14 of the blade 4. In other words, the both ends of the pressure surface 13 of the blade 4 are convex toward the side of the pressure surface 13.

That is, the surface of the pressure surface 13 of the blade 4 is formed by a curved surface where the arcs having the radius of curvature R1 and the arc having the radius of curvature R2 are connected (a curved surface whose end portions are convex and whose center portion is concave). One of the connection positions of the arcs are shown by a point A in FIG. 4, and the connection positions are distant from the both end portions of the blade 4 by a length of ⅕ of the length L of the blade chord line 12.

Meanwhile, the center portion of the surface of the suction surface 14 of the blade 4 is formed in an arc having a predetermined radius of curvature R4, and both end sides of the suction surface 14 of the blade 4 are formed in arcs having a predetermined radius of curvature R3 (FIG. 5). The center of the radius of curvature R3 and the center of the radius of curvature R4 are provided at a side of the pressure surface 13 of the blade 4. In other words, the suction surface 14 of the blade 4 is convex toward the side of the suction surface 14 at any position.

That is, the surface of the suction surface 14 of the blade 4 is formed from a curved surface where the arcs having the radius of curvature R3 and the arc having the radius of curvature R4 are connected. One of the connected positions of the arcs is shown by a point B in FIG. 4. The point B is a point where a straight line passing the point A and extending in a rotation axis direction of the blade 4 intersects with the suction surface 14.

As the values of R1 to R4 with respect to the length L of the blade chord line 12, the following values are preferable.

R1 is 0.6 to 0.8 times of the length L

R2 is 70 to 90 times of the length L

R3 is 3 to 4 times of the length L

R4 is 4 to 5 times of the length L

As shown in the cross-sectional view of FIG. 5, in the cross-sectional view of the blade end portion, a length X from the blade chord line 12 to the surface of the pressure surface 13 is larger than a length Y from the blade chord line 12 to the surface of the suction surface 14. Further, as shown in the cross-sectional view of FIG. 3, at the center portion of the blade, the length X from the blade chord line 12 to the surface of the pressure surface 13 is almost equal to the length Y from the blade chord line 12 to the surface of the suction surface 14. In other words, a relation of ($X \geq Y$) is satisfied.

Also, as shown in FIG. 3, the blade 4 has a line-symmetric shape with an axis passing through a center point 15 of the blade chord length L and perpendicular to the blade chord line 12, as a symmetry axis 16.

An attachment angle of the blade 4 represents an angle which is formed by the blade chord line 12 which is a straight line connecting the leading edge 10 of the blade 4 and the trailing edge 11 of the blade 4, and a plane perpendicular to a rotation axis line. The attachment angle of the blade 4 generally depends on the position of the blade 4 in a radial direction. An attachment angle at the root side (portion which is attached to the hub 5) of the blade 4 is 33°, and an attachment angle at the tip end side of the blade 4 is smaller than the attachment angle at the root side of the blade 4. For example, the attachment angle at the tip end side is 75% to 80% of the attachment angle at the root side (portion which is attached to the hub 5) of the blade 4.

Figure 6:
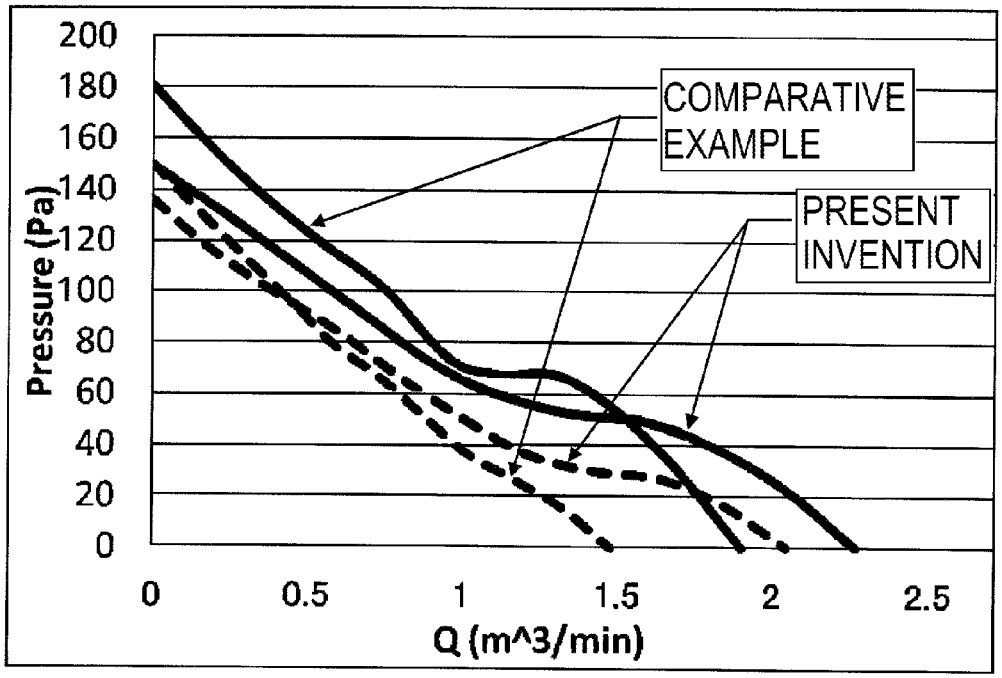
FIG. 6 is a view showing the air flow rate Q-static pressure characteristics of the axial flow fan of the illustrative embodiment and that of an axial flow fan of a comparative example.
Figure 7:
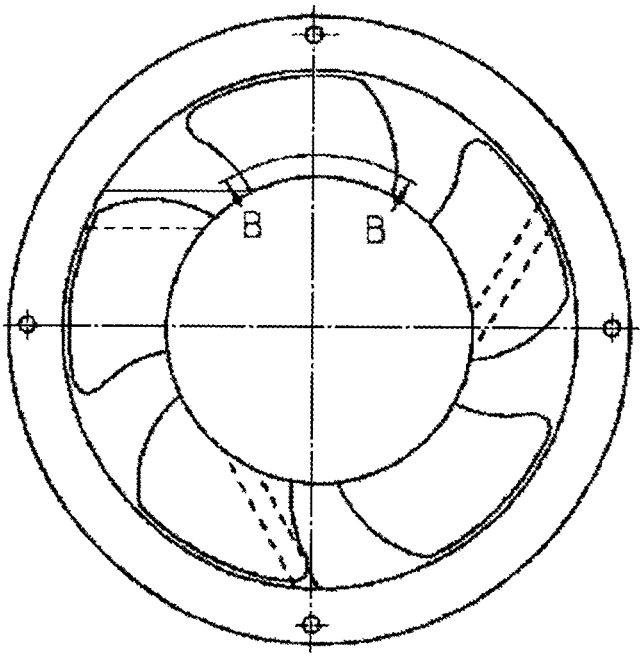
FIG. 7 is a front view showing a related-art axial flow fan.

FIG. 6 is a graph showing the air flow rate Q-static pressure characteristics of the axial flow fan 1 of the present illustrative embodiment having the blade shape shown in FIG. 2 and an axial flow fan of a comparative example.

Figure 8:
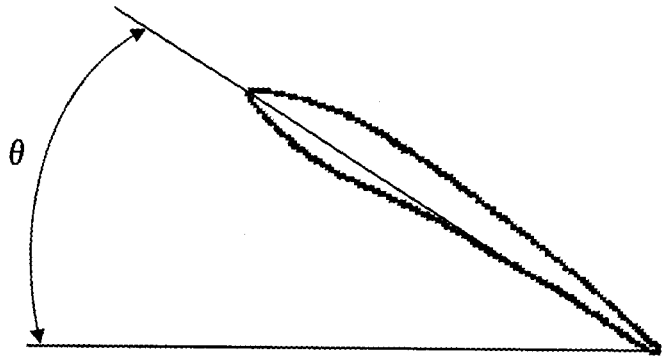
FIG. 8 is a cross-sectional view showing a blade of FIG. 7.
Figure 9:
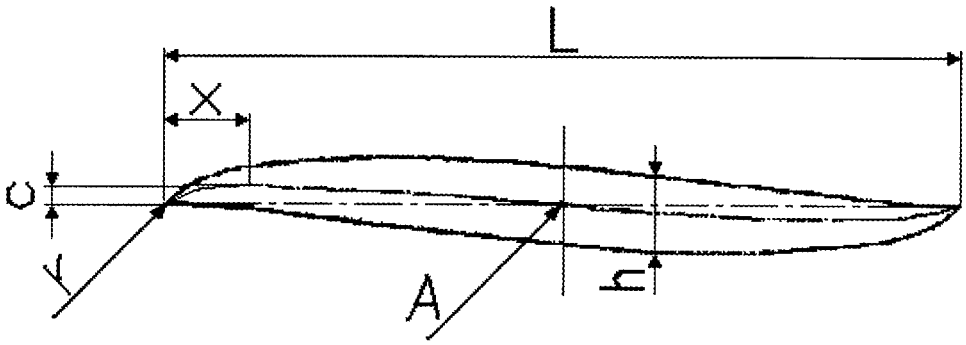
FIG. 9 is a cross-sectional view showing a blade of a related-art bi-directional axial blower rotatable in a normal direction and a reverse direction.

The axial flow fan of the comparative example has a blade shape bent with respect to a rotation direction for increasing an air flow such that a pressure surface side is convex, as shown in FIG. 8. The attachment angle at the root side of each blade is 62°, and the attachment angle at the tip end side of the blade is smaller than the attachment angle at the root side of the blade (here, the attachment angle at the tip end side of the blade is set to 65% of the attachment angle at the root side of the blade). Also, even in the comparative example, similarly to FIG. 2, the number of blades is five and the blades are forward swept blades.

In FIG. 6, solid lines represent air flow rate-static pressure characteristics during normal rotation, and broken lines represent air flow rate-static pressure characteristics during reverse rotation.

As shown in FIG. 6, the maximum static pressure of the axial flow fan 1 of the illustrative embodiment is slightly lower than that of the axial flow fan of the comparative example, but the maximum air flow rate of the axial flow fan 1 shows an increase from that of the axial flow fan of the comparative example. This is because the attachment angle of the blade of the axial flow fan 1 of the illustrative embodiment is smaller than the attachment angle of the blade of the comparative example.

The axial flow fan of the comparative example represents a characteristic in which the maximum air flow rate during reverse rotation is about 79% of that during normal rotation, whereas the axial flow fan of the present illustrative embodiment represents a characteristic in which the maximum air flow rate during reverse rotation is about 90% of that during normal rotation. That is, as compared to the axial flow fan of the comparative example, the axial flow fan of the present illustrative embodiment is slightly worse in the maximum static pressure, but shows an increase in the maximum air flow rate, and has the characteristic in which the maximum air flow rate during reverse rotation is about 90% of that during normal rotation.

Accordingly, the axial flow fan of the present illustrative embodiment has an optimized blade shape, and thus can maintain an air flow characteristic in a normal rotation direction while suppressing a significant deterioration in the air flow characteristic even in a case of rotating in a reverse direction.

Herein, in the above-described illustrative embodiment, although the number of blades is five, the present invention is not limited thereto. Further, the values of the shape and size of the blade are merely preferable examples, and can be variously changed within the scope of the claims.

The shape of each blade may be a forward swept blade or a sweptback blade.

Further, the blades may have any shape as long as a shape at one face side is different from a shape at the other (opposite) face side, and its variation is not limited to that shown in FIG. 3. For example, the shape of the pressure surface during normal rotation may have any shape as long as it is different from the shape of the suction surface, and thus may be a concave shape or a planar or convex shape. Similarly, the shape of the suction surface during the normal rotation may have any shape as long as it is different from the shape of the pressure surface, and thus may be a convex shape or a planar or concave shape.

It should be understood that the illustrative embodiments disclosed herein are illustrative and non-restrictive in every respect. The scope of the present invention is defined by the terms of the claims, rather than the description above, and is intended to include any modifications within the scope and meaning equivalent to the terms of the claims.

What is claimed is:

1. An impeller for an axial flow fan that is operable in a normal rotation and in a reverse rotation, the impeller comprising:

a plurality of blades arranged in a circumferential direction, wherein each of the blades has:

a first face that has a first three-dimensional shape and serves as a pressure surface during the normal rotation;

a second face that has a second three-dimensional shape that is different from the first three-dimensional shape and serves as a suction surface during the normal rotation;

a leading edge portion that connects the first face and the second face and is located at a front side during the normal rotation; and a trailing edge portion that connects the first face and the second face and is located at a rear side during the normal rotation, wherein the first face and the second face are configured to have a different cross-sectional shape with each other, wherein the leading edge portion and the trailing edge portion are configured to have a line-symmetric shape with respect to a center point of a chord length L, wherein each of the first face and the second face is defined to have a center portion and end portions that are arranged at each of two sides of the center portion and smoothly connected with the center portion, wherein each of the end portions of the first face is formed in an arc shape having a curvature radius R1 and a center of curvature being located adjacent the second face, wherein the center portion of the first face is formed in an arc shape having a curvature radius R2 and a center of curvature being located adjacent the first face, wherein each of the end portions of the second face is formed in an arc shape having a curvature radius R3 and a center of curvature being located adjacent the first face, and wherein the center portion of the second face is formed in an arc shape having a curvature radius R4 and a center of curvature being located adjacent the first face, wherein the curvature radius R1 is set to be in a range from 0.6 to 0.8 times of the chord length L, wherein the curvature radius R2 is set to be in a range from 70 to 90 times of the chord length L, wherein the curvature radius R3 is set to be in a range from 3 to 4 times of the chord length L, and wherein the curvature radius R4 is set to be in a range from 4 to 5 times of the chord length L.

2. The impeller according to claim 1, wherein a length X from a blade chord line to a surface of the first face is larger than a length Y from the blade chord line to a surface of the second face except at a center of the blade where the length X is equal to the length Y.

3. The impeller according to claim 1, wherein the first face serves as a suction surface during the reverse rotation, and wherein the second face serves as a pressure surface during the reverse rotation.

4. An axial flow fan comprising:

an impeller including a plurality of blades arranged in a circumferential direction;

a motor, attached to the impeller, which rotates the impeller in a normal rotation and in a reverse rotation; and a casing that accommodates the impeller and has a base portion that supports the motor, wherein each of the blades has:

a first face that has a first three-dimensional shape and serves as a pressure surface during the normal rotation;

a second face that has a second three-dimensional shape that is different from the first three-dimensional shape and serves as a suction surface during the normal rotation;

a leading edge portion that connects the first face and the second face and is located at a front side during the normal rotation; and a trailing edge portion that connects the first face and the second face and is located at a rear side during the normal rotation, wherein the first face and the second face are configured to have a different cross-sectional shape with each other, wherein the leading edge portion and the trailing edge portion are configured to have a line-symmetric shape with respect to a center point of a chord length L, wherein each of the first face and the second face is defined to have a center portion and end portions that are arranged at each of two sides of the center portion and smoothly connected with the center portion, wherein each of the end portions of the first face is formed in an arc shape having a curvature radius R1 and a center of curvature being located adjacent the second face, wherein the center portion of the first face is formed in an arc shape having a curvature radius R2 and a center of curvature being located adjacent the first face, wherein each of the end portions of the second face is formed in an arc shape having a curvature radius R3 and a center of curvature being located adjacent the first face, and wherein the center portion of the second face is formed in an arc shape having a curvature radius R4 and a center of curvature being located adjacent the first face, wherein the curvature radius R1 is set to be in a range from 0.6 to 0.8 times of the chord length L, wherein the curvature radius R2 is set to be in a range from 70 to 90 times of the chord length L, wherein the curvature radius R3 is set to be in a range from 3 to 4 times of the chord length L, and wherein the curvature radius R4 is set to be in a range from 4 to 5 times of the chord length L.

5. The axial flow fan according to claim 4, wherein a length X from a blade chord line to a surface of the first face is larger than a length Y from the blade chord line to a surface of the second face except at a center of the blade where the length X is equal to the length Y.

6. The axial flow fan according to claim 4, wherein the first face serves as a suction surface during the reverse rotation, and wherein the second face serves as a pressure surface during the reverse rotation.

* * * * *